US006736763B1

(12) United States Patent
Hsu

(10) Patent No.: US 6,736,763 B1
(45) Date of Patent: May 18, 2004

(54) JUMP ROPE DEVICE

(76) Inventor: Cheng-Hsiung Hsu, No. 29-18, Kou-Chien La., Kou-Chien Li, Lu-Kang Town, Changhua Hsien (TW)

( * ) Notice: Subject to any disclaimer, the term of this patent is extended or adjusted under 35 U.S.C. 154(b) by 0 days.

(21) Appl. No.: 10/303,971

(22) Filed: Nov. 26, 2002

(51) Int. Cl.[7] ..... A63B 5/20
(52) U.S. Cl. ..... 482/82; 482/81; 482/126
(58) Field of Search ..... 482/81, 82, 74, 482/121–126, 907; 472/135; 446/120

(56) References Cited

U.S. PATENT DOCUMENTS 4,647,037 A * 3/1987 Donohue ..... 482/82
4,801,137 A * 1/1989 Douglass ..... 482/82
5,092,583 A * 3/1992 Rudolf ..... 482/82
6,193,637 B1 * 2/2001 Corbin ..... 482/21
6,544,148 B1 * 4/2003 Loew ..... 482/82

* cited by examiner

*Primary Examiner*—Jerome W. Donnelly
(74) *Attorney, Agent, or Firm*—Rosenberg, Klein & Lee

(57) ABSTRACT

It includes a pair of handles, a jump rope, and a pair of ball chains. Each handle has a recess and a cover. The ball chain has several ball units linearly connected. This ball chain has a first fixing portion to connect with the jump rope and a second fixing portion to secure with the handle. The ball chain is pretty pliant and easy to deform, so that the rotational friction and drag between the jump rope and the handle during high-speed rope jumping can be significantly minimized.

2 Claims, 2 Drawing Sheets

JUMP ROPE DEVICE

BACKGROUND OF INVENTION

1. Field of the Invention

This invention relates to a jump rope device. Specifically, this invention relates to a jump rope structure having two ball chains, so that the rotational friction and drag during high-speed rope jumping can be significantly minimized.

2. Description of the Prior Art

A traditional jump rope mainly comprises a rope and a pair of handles. During a high-speed rope jumping, the handles held by a user do not rotate, but the rope is rotating. Under this circumstance, the rotational friction and drag are generated. These friction and drag not only damage the jump rope structure but also limit the maximum speed of rope jumping exercise.

Hence, a ball bearing attachment was invented to solve the above-mentioned problem. As shown in FIG. 1, it shows a ball-bearing swivel 80 (U.S. Pat. No. 2,466,243) for a jump rope structure. In which, a pair of ball bearing 81 is disposed inside. Each ball bearing 81 extends out a connecting ring 82 and further connects with a rope (not shown) or a handle (not shown). Therefore, when the rope is rotated at a high speed, the generated friction and drag will be absorbed by the low frictional ball bearing 81. Thus, the user can achieve a high-speed rope jumping exercise.

Another jump rope structure (U.S. Pat. No. 5,749,812) was invented later, as shown in FIG. 2. It comprises a pair of handles 91, a rope 92 and a pair of ball-bearing swivel 93. One end of the ball-bearing swivel 93 is disposed with a threaded portion 931. The other end of the ball-bearing swivel 93 is disposed with a rotatable spindle 932. Some portion of this rotatable spindle 932 extends out and connects with an O-ring 94 that is secured on one end of the rope 92. The handle 91 has a threaded hole 911 so as to fix with the threaded portion 931. Similarly, the ball-bearing swivel 931 basically can be rotated freely (over 360 degree). It also can reduce the rotational friction and drag between the rope 92 and the handle 91.

SUMMARY OF THE INVENTION

The primary object of the present invention is to provide a jump rope utilizing the unique ball chain design so that the rotational friction and drag during high-speed rope jumping can be significantly minimized The second object of the present invention is to provide a jump rope device that is different to the existing patented structures.

DETAILED DESCRIPTION OF THE PREFERRED EMBODIMENT

Figure 1:
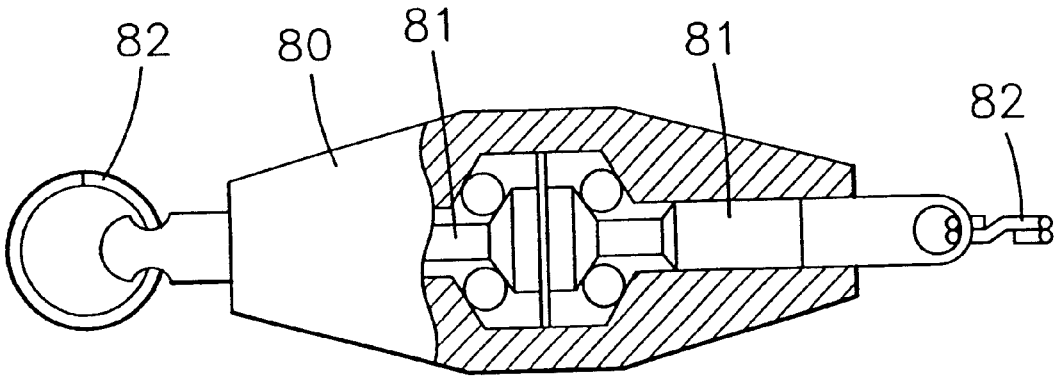
FIG. 1 (PRIOR ART)
FIG. 1 shows a traditional ball-bearing swivel for a jump rope.
Figure 2:
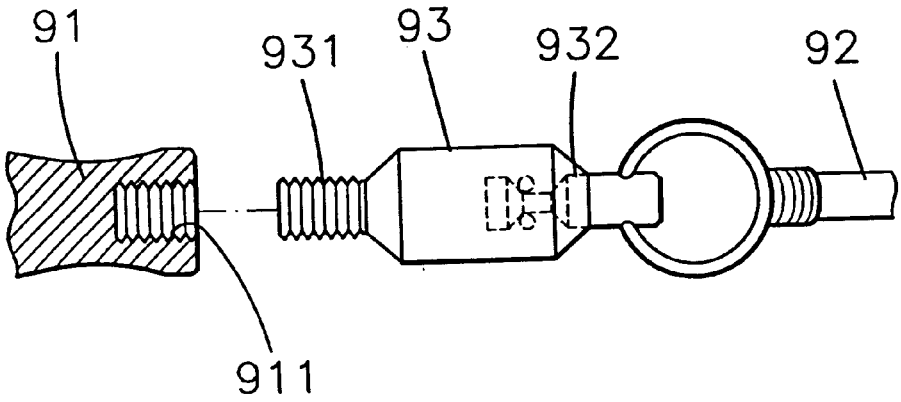
FIG. 2 (PRIOR ART)
FIG. 2 shows another traditional ball-bearing swivel.
Figure 3:
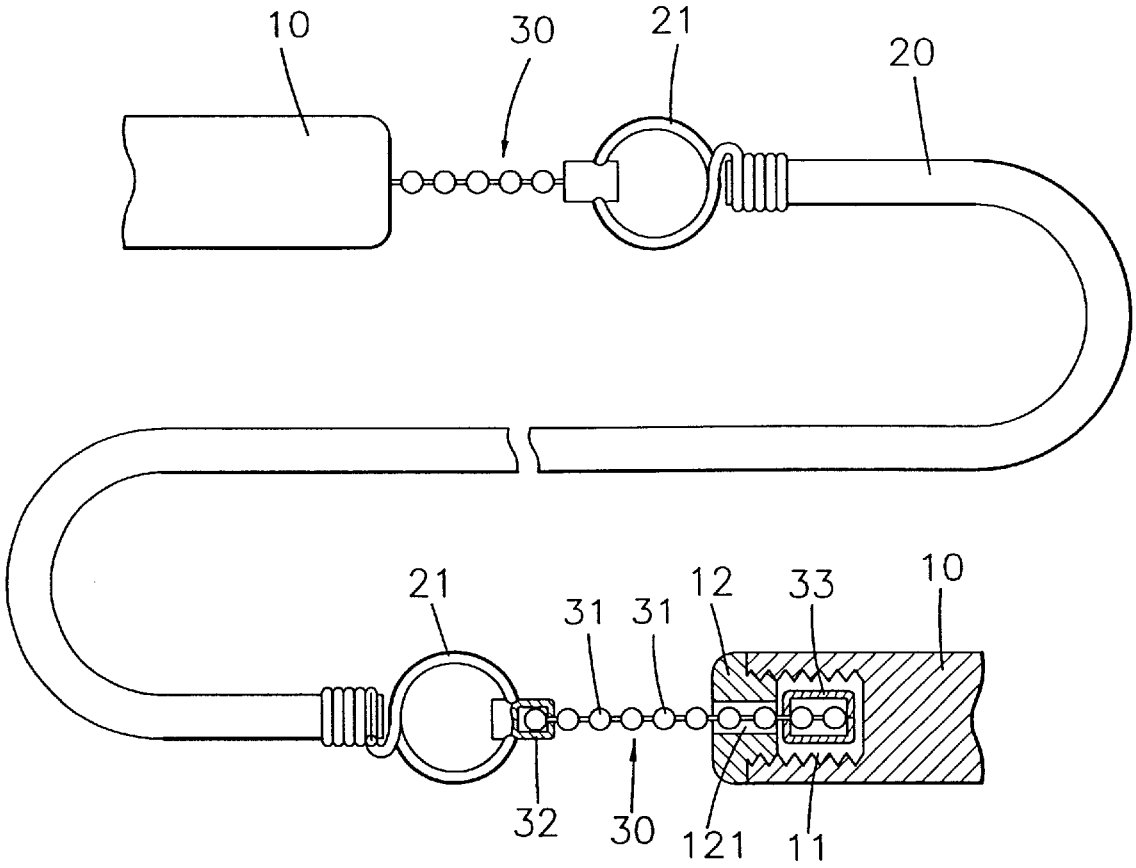
FIG. 3 is a front view of this invention and shows its inner structure at a selected portion.
Figure 4:
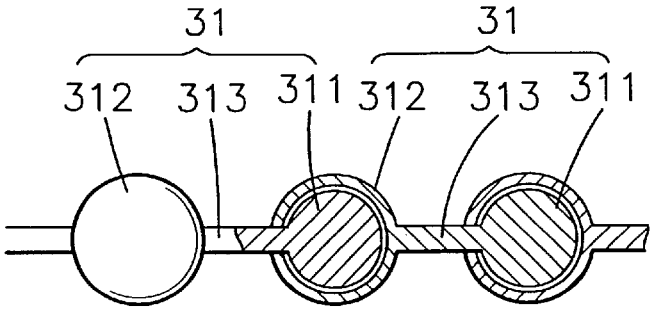
FIG. 4 shows the inner structure of two adjacent ball units.

This invention is a jump rope device. It comprises a pair of handle 10, a jump rope 20 and a pair of ball chains 30.

With regard to this pair of handles 10, one end of each handle 10 has a recess 11. A cover 12 is disposed on the recess 11. The cover 12 has a centrally oriented channel 121.

About the jump rope 20, two ends of the jump rope 20 are disposed with one (or more) ring-shaped element 21.

Concerning this pair of ball chains 30, each ball chain 30 has at least five linearly connected ball units 31, Usually, six to twelve ball units are preferable. Each ball unit 31 includes a ball-shaped end 311, a shell-shaped end 312, and a linking rod 313 for connecting the ball-shaped end 311 and the shell-shaped end 312. The shell-shaped end 312 has a cavity 314 for pivotally receiving a ball-shaped end 311 of an adjacent ball unit 31. And, there is a small opening 315 for allowing the linking rod 313 of the adjacent ball unit 31 to protrude out. In fact, this small opening 315 is formed after the ball-shaped end 311 properly inserting into the adjacent shell-shaped end by punching or bending the outer edge of the shell-shaped end 312 inwardly. Furthermore, one end of the ball chain 31 is disposed with a first fixing portion 32 to connect with the ring-shaped element 21 of the jump rope 20. The other end of the ball chain 31 is disposed with a second fixing portion 33 for fixing one end of the ball chain 31 in the recess 11 of the handle 10.

More specifically, an inner diameter of the channel 121 of the cover 12 is slightly larger than an outer diameter of the shell-shaped end 312 of the ball unit 31. Also, the inner diameter of the channel 121 of the cover 12 is smaller than the outer edge of the second fixing portion 33 of said ball chain 30 so as to allow the second fixing portion 33 to be locked and secured in the recess 11.

Therefore, because every two adjacent ball units 31 are pivoted, they can allow a relative free rotation (over 360 degrees) about the axis of the linking rod 313. In addition, each linking rod 313 can be moved (or rotated) within certain range (for example, less than 45 degrees). By utilizing these linearly connected ball units 31, the ball chain 30 is pretty pliant and easy to deform (or bend). Thus, the friction and drag between the jump rope 20 and the handle 10 are extremely low. So, a high-speed rope jumping is possible for the user.

By utilizing the above-mentioned handles 10, jump rope 20 and ball chains 30, the rotational friction and drag during high-speed rope jumping can be significantly minimized.

Besides, this invention has a unique structure that is different to the one defined in U.S. Pat. Nos. 5,749,812 or 2,466,243.

The above embodiments are only used to illustrate the present invention, not intended to limit the scope thereof. Many modifications of the above embodiments can be made without departing from the spirit of the present invention.

I claim:

1. A jump rope device comprising:

a pair of handles, one end of each handle having a recess, a cover being disposed on said recess, said cover having a channel;

a jump rope, two ends of said jump rope being disposed with at least one ring-shaped element; and a pair of ball chains, each ball chain having at least five linearly connected ball unit, each ball unit including a ball-shaped end, a shell-shaped end, and a linking rod for connecting said ball-shaped end and said shell-shaped end, said shell-shaped end having a cavity for pivotally receiving an ball-shaped end of an adjacent ball unit and a small opening for allowing said linking rod of said adjacent ball unit to protrude out, one end of said ball chain being disposed with a first fixing portion to connect with said ring-shaped element of said jump rope, the other end of said ball chain being disposed with a second fixing portion for fixing in said recess of said handle.

2. A jump rope as claimed in claim 1, wherein an inner diameter of said channel of said cover is slightly larger than an outer diameter of said shell-shaped end of the ball unit, and said inner diameter of said channel of said cover is smaller than the outer edge of said second fixing portion of said ball chain so as to allow said second fixing portion to be locked and secured in said recess.

* * * * *